US010324398B2

(12) United States Patent
Okuyama

(10) Patent No.: US 10,324,398 B2
(45) Date of Patent: Jun. 18, 2019

(54) DEVELOPING DEVICE AND MAGNET FOR TWO-COMPONENT DEVELOPMENT

(71) Applicant: CANON KABUSHIKI KAISHA, Tokyo (JP)

(72) Inventor: Yuta Okuyama, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/698,409

(22) Filed: Sep. 7, 2017

(65) Prior Publication Data

US 2018/0074441 A1 Mar. 15, 2018

(30) Foreign Application Priority Data

Sep. 12, 2016 (JP) ..... 2016-177989
Jul. 6, 2017 (JP) ..... 2017-132909

(51) Int. Cl.
*G03G 15/08* (2006.01)
*G03G 15/09* (2006.01)

(52) U.S. Cl.
CPC ..... *G03G 15/0921* (2013.01); *G03G 15/0893* (2013.01)

(58) Field of Classification Search
CPC ..... G03G 15/0921
USPC ..... 399/273, 277
See application file for complete search history.

(56) References Cited

U.S. PATENT DOCUMENTS 4,517,719 A * 5/1985 Okumura ..... G03G 15/0921 492/38
5,434,351 A * 7/1995 Iwai ..... G03G 15/09 399/275
6,070,038 A * 5/2000 Imamura ..... G03G 15/0921 399/277
6,496,675 B1 * 12/2002 Sugiyama ..... G03G 15/0921 399/277
9,335,666 B2 * 5/2016 Sakamaki ..... G03G 15/0921
2003/0049053 A1 * 3/2003 Kurosu ..... G03G 15/09 399/267

(Continued)

FOREIGN PATENT DOCUMENTS

JP 2001-015327 A 1/2001
JP 2002-148921 A 5/2002

(Continued)

*Primary Examiner* — Robert B Beatty
(74) *Attorney, Agent, or Firm* — Canon USA, Inc., IP Division

(57) ABSTRACT

A groove is provided in a magnet such that a first magnetic force region where an absolute value of a magnetic force of a component in a direction normal to a developer carrying member is 1 [nN] or less is formed on a surface of the developer carrying member on a downstream side of a third maximum peak position and on an upstream side of a second maximum peak position in a rotation direction of the developer carrying member, and a second magnetic force region where the absolute value of the magnetic force of the component in the direction normal to the developer carrying member is 1 [nN] or less is formed on the surface of the developer carrying member on a downstream side of a first maximum peak position and on an upstream side of the third maximum peak position in the rotation direction of the developer carrying member.

20 Claims, 9 Drawing Sheets

(56) References Cited

U.S. PATENT DOCUMENTS

2009/0245889 A1* 10/2009 Koetsuka ..... G03G 15/0921
399/277

FOREIGN PATENT DOCUMENTS

JP 2003-316159 A 11/2003
JP 2004-247722 A 9/2004

* cited by examiner

MAGNETIC FLUX DENSITY [mT]
MAGNETIC ATTRACTION FORCE [N]
Br
Fr
N3 POLE
N4 POLE
LOCAL MINIMUM POINT
ANGLE [degree]
50
45
40
35
30
25
20
15
10
5
0
-5.00E-08
-4.00E-08
-3.00E-08
-2.00E-08
-1.00E-08
-1.00E-21
40
50
60
70
80
90
100

DEVELOPING DEVICE AND MAGNET FOR TWO-COMPONENT DEVELOPMENT

BACKGROUND

Field

The present disclosure generally relates to a developing device and a magnet for two-component development.

Description of the Related Art

A developing device includes a developing sleeve as a rotatable developer carrying member that carries a two-component developer including a non-magnetic toner and a magnetic carrier. A magnet for two-component development is fixedly arranged inside the developing sleeve. The magnet has a plurality of magnetic poles and causes a surface of the developing sleeve to carry the two-component developer. The two-component developer (hereinbelow simply referred to as a developer) carried on the surface of the developing sleeve is conveyed to a region where an electrostatic latent image on a surface of a photosensitive drum as an image bearing member is developed (development region). Then, when the developer carried on the surface of the developing sleeve is subjected to development in the development region, the toner in the developer is consumed, leading to a decrease in the toner density in the developer.

In the developer subjected to development and having a decreased toner density, a repulsive magnetic field is formed between magnetic poles of the same polarity of the magnet. The developer is then conveyed to a magnetic force region (peel-off region) where an absolute value of a magnetic force in a direction normal to the developing sleeve is 1 [nN] or less. The developer subjected to development in the development region and having a decreased toner density acts to separate from the developing sleeve in the peel-off region. Then, the developer separated from the developing sleeve in the peel-off region is collected in a developing container. The developer collected in the developing container is agitated with a developer already existing in the developing container, whereby the toner density is made uniform.

In a case where the developer subjected to development is not sufficiently separated from the developing sleeve, the developer having a decreased toner density is subjected to development again in the development region along with rotation of the developing sleeve. As a result, there is a possibility that the toner density in the developer to be subjected to development becomes non-uniform and an image failure occurs. This is especially problematic at the time of forming a solid image. Therefore, it is necessary to sufficiently separate the developer, which has been subjected to development and has a decreased toner density, from the developing sleeve.

In the developing device discussed in Japanese Patent Application Laid-Open No. 2002-148921, a rotatable stripping roller including a magnet body therein is arranged near a developer-stripping magnetic pole (hereinbelow referred to as a stripping pole) of a developer carrying member. In this developing device, a developer carried on the developer carrying member is attracted to the stripping roller by magnetic poles inside the stripping roller. This improves peelability of the developer near the stripping pole.

In recent years, the size of the developing device has been reduced, and the diameter of the developing sleeve has been reduced accordingly. If the diameter of the developing sleeve is reduced, the magnet inside the developing sleeve becomes smaller than when the developing sleeve has a large diameter. As a result, the distance between the magnetic poles in the rotation direction of the developing sleeve becomes short and the peel-off region becomes narrow. This tends to make it difficult for the developer subjected to development to separate from the developing sleeve.

In the case of adopting a configuration in which a new magnet is externally added near the stripping pole as in the stripping roller discussed in Japanese Patent Application Laid-Open No. 2002-148921, a space for arranging the new magnet needs to be provided outside the developing sleeve, leading to an increase in the size of the developing device.

Meanwhile, if there are two (although narrow) peel-off regions, the developer subjected to development can undergo two peeling steps. This tends to make it easy for the developer subjected to development to separate from the developing sleeve. Therefore, it is desirable to improve peelability of the developer near the stripping pole and to reduce the size of the developing device, by adjusting a magnetic force pattern near the stripping pole to obtain two peel-off regions without arranging a new magnet outside the developing sleeve.

SUMMARY

Aspects of the present invention are generally directed to a developing device and a magnet for two-component development, which can promote peeling off a two-component developer subjected to development from a developer carrying member by adjusting a magnetic force pattern to obtain two peel-off regions with a simple configuration.

According to an aspect of the present invention, a developing device includes a developer carrying member rotatably provided and configured to carry a developer containing a toner and a magnetic carrier for developing an electrostatic latent image formed on an image bearing member, and a magnet fixedly arranged inside the developer carrying member, and including a first magnetic pole and a second magnetic pole arranged adjacent to the first magnetic pole in a rotation direction of the developer carrying member and having the same polarity as the first magnetic pole, the magnet being configured to generate a magnetic field for peeling off, from a surface of the developer carrying member, the developer which has passed through a development region facing the image bearing member, wherein a groove is provided in the magnet over an entire region of the magnet in a longitudinal direction thereof to satisfy the following (i) to (iii): (i) a third maximum peak position where a magnetic flux density of a component in a direction normal to the developer carrying member becomes maximal is on the surface of the developer carrying member on a downstream side of a first maximum peak position where the magnetic flux density of the component in the direction normal to the developer carrying member at the first magnetic pole becomes maximal and on an upstream side of a second maximum peak position where the magnetic flux density of the component in the direction normal to the developer carrying member at the second magnetic pole becomes maximal in the rotation direction of the developer carrying member, (ii) a minimum peak position where the magnetic flux density of the component in the direction normal to the developer carrying member becomes minimal is on the surface of the developer carrying member on the downstream side of the first maximum peak position and on an upstream side of the third maximum peak position in the rotation direction of the developer carrying member, and the magnetic flux density of the component in the direction normal to the developer carrying member at the minimum peak position is more than 30% and less than 95% of the magnetic flux density of the component in the direction normal to the developer carrying member at the first maximum peak position, and (iii) a first magnetic force region where an absolute value of a magnetic force of the component in the direction normal to the developer carrying member is 1 [nN] or less is formed on the surface of the developer carrying member on a downstream side of the third maximum peak position and on the upstream side of the second maximum peak position in the rotation direction of the developer carrying member, and a second magnetic force region where the absolute value of the magnetic force of the component in the direction normal to the developer carrying member is 1 [nN] or less is formed on the surface of the developer carrying member on the downstream side of the first maximum peak position and on the upstream side of the third maximum peak position in the rotation direction of the developer carrying member.

According to another aspect of the present invention, a magnet for two-component development fixedly arranged inside a rotatable developer carrying member includes a first magnetic pole, and a second magnetic pole arranged adjacent to the first magnetic pole in a rotation direction of the developer carrying member and having the same polarity as the first magnetic pole, wherein a groove is provided in the magnet over an entire region of the magnet in a longitudinal direction thereof to satisfy the following (i) to (iii): (i) a third maximum peak position where a magnetic flux density of a component in a direction normal to the developer carrying member becomes maximal is on a surface of the developer carrying member on a downstream side of a first maximum peak position where the magnetic flux density of the component in the direction normal to the developer carrying member at the first magnetic pole becomes maximal and on an upstream side of a second maximum peak position where the magnetic flux density of the component in the direction normal to the developer carrying member at the second magnetic pole becomes maximal in the rotation direction of the developer carrying member, (ii) a minimum peak position where the magnetic flux density of the component in the direction normal to the developer carrying member becomes minimal is on the surface of the developer carrying member on the downstream side of the first maximum peak position and on an upstream side of the third maximum peak position in the rotation direction of the developer carrying member, and the magnetic flux density of the component in the direction normal to the developer carrying member at the minimum peak position is more than 30% and less than 95% of the magnetic flux density of the component in the direction normal to the developer carrying member at the first maximum peak position, and (iii) a first magnetic force region where an absolute value of a magnetic force of the component in the direction normal to the developer carrying member is 1 [nN] or less is formed on the surface of the developer carrying member on a downstream side of the third maximum peak position and on the upstream side of the second maximum peak position in the rotation direction of the developer carrying member, and a second magnetic force region where the absolute value of the magnetic force of the component in the direction normal to the developer carrying member is 1 [nN] or less is formed on the surface of the developer carrying member on the downstream side of the first maximum peak position and on the upstream side of the third maximum peak position in the rotation direction of the developer carrying member.

Further features of aspects of the present invention will become apparent from the following description of exemplary embodiments with reference to the attached drawings.

DESCRIPTION OF THE EMBODIMENTS

Hereinbelow, exemplary embodiments of the present invention will be described in detail with reference to the accompanying drawings. It should be noted that the present invention according to the claims is not limited to the following exemplary embodiments, and all combinations of features described in the exemplary embodiments are not necessarily indispensable to the solution to be provided by the present invention. Aspects of the present invention can be implemented in various applications such as a printer, various printing machines, a copying machine, a facsimile (FAX), and a multifunction peripheral.

(Configuration of Image Forming Apparatus)

First, a configuration of an image forming apparatus according to a first exemplary embodiment of the present invention will be described with reference to a cross-sectional view of FIG. 1.

Figure 1:
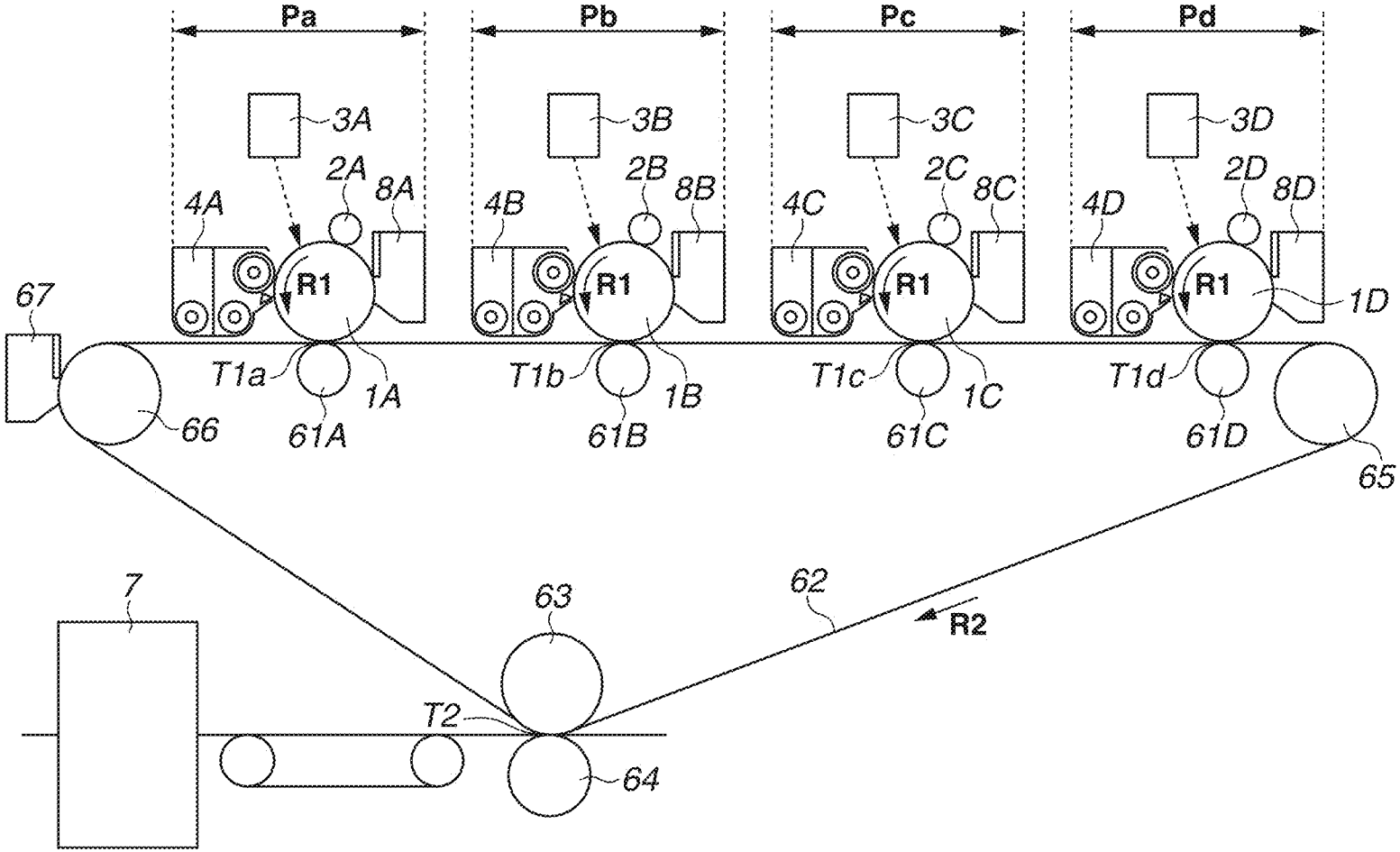
FIG. 1 is a cross-sectional view illustrating a configuration of an image forming apparatus according to a first exemplary embodiment.

As illustrated in FIG. 1, the image forming apparatus includes an endless intermediate transfer belt (ITB) 62 as an intermediate transfer member, and four image forming units P (Pa, Pb, Pc, and Pd) from an upstream side to a downstream side in a rotation direction (direction indicated by an arrow R2 illustrated in FIG. 1) of the ITB 62.

In the first exemplary embodiment, a tandem type apparatus, an intermediate transfer type apparatus, and a full color printer will be described as examples of the image forming apparatus, but a single drum type/tandem type apparatus, a direct transfer type/intermediate transfer type apparatus, and a full color printer/monochrome printer may be arbitrarily combined.

The image forming units P (Pa, Pb, Pc, and Pd) form toner images with the colors of yellow (Y), magenta (M), cyan (C), and black (Bk), respectively. The image forming units P (Pa, Pb, Pc, and Pd) include rotatable photosensitive drums 1 (1A, 1B, 1C, and 1D) as image bearing members respectively. In the first exemplary embodiment, a drumshaped organic photosensitive member will be described as an example of the photosensitive drums 1 (1A, 1B, 1C, and 1D), but the photosensitive drum may be an inorganic photosensitive member such as an amorphous silicon photosensitive member, or may be a belt-shaped photosensitive member. In addition, the charging method, the developing method, the transfer method, the cleaning method, and the fixing method are not limited to the methods described below.

Each of the photosensitive drums 1 (1A, 1B, 1C, and 1D) is rotationally driven in a rotation direction (direction indicated by an arrow R1 illustrated in FIG. 1) at a predetermined process speed. Chargers 2 (2A, 2B, 2C, and 2D) as charging units, and exposure devices 3 (3A, 3B, 3C, and 3D) as latent image forming units are disposed around the photosensitive drums 1 (1A, 1B, 1C, and 1D) and along the rotation direction of the photosensitive drums 1 (1A, 1B, 1C, and 1D), respectively. Developing devices 4 (4A, 4B, 4C, and 4D) as developing units, and primary transfer rollers 61 (61A, 61B, 61C, and 61D) as primary transfer units are further disposed around the photosensitive drums 1 (1A, 1B, 1C, and 1D) and along the rotation direction of the photosensitive drums 1 (1A, 1B, 1C, and 1D), respectively. Furthermore, photosensitive member cleaning devices 8 (8A, 8B, 8C, and 8D) as photosensitive member cleaners are disposed around the photosensitive drums 1 (1A, 1B, 1C, and 1D), respectively. The photosensitive member cleaning device 8 collects toner that has not been primarily transferred to the ITB 62 but has remained on the photosensitive drum 1.

Each of the developing devices 4 (4A, 4B, 4C, and 4D) is detachably attached to the image forming apparatus. Furthermore, each of the developing devices 4 (4A, 4B, 4C, and 4D) has a developing container that stores the developer. Note that details of the developing device 4 will be described below with reference to FIGS. 2 and 3.

In the photosensitive drum 1 (1A, 1B, 1C, or 1D), a photosensitive layer having a negative charging polarity is formed on the outer peripheral surface of an aluminum cylinder. The charger 2 (2A, 2B, 2C, or 2D) charges the surface of the photosensitive drum 1 (1A, 1B, 1C, or 1D) to a uniform negative dark portion potential Vd [V]. Subsequently, the exposure device 3 (3A, 3B, 3C, or 3D) performs scanning with a rotary mirror using a laser beam to form an electrostatic image (electrostatic latent image) on the surface of the charged photosensitive drum 1 (1A, 1B, 1C, or 1D). Each of the developing devices 4 (4A, 4B, 4C, and 4D) develops the electrostatic latent image using the developer, and forms a toner image on the surface of the photosensitive drum 1 (1A, 1B, 1C, or 1D).

The ITB 62 is wound around the primary transfer rollers 61 (61A, 61B, 61C, and 61D), a tension roller 65, a secondary-transfer counter roller 63, and a tension roller 66.

Each of the primary transfer rollers 61 (61A, 61B, 61C, and 61D) presses the inner surface of the ITB 62, and forms a transfer section of the toner image between the photosensitive drum 1 (1A, 1B, 1C, or 1D) and the ITB 62. This transfer section is a primary transfer nip section T1 (T1*a*, T1*b*, T1*c*, or T1*d*) as a primary transfer section. By applying a positive direct current (DC) voltage to the primary transfer roller 61 (61A, 61B, 61C, or 61D), the toner image of negative polarity carried on the photosensitive drum 1 (1A, 1B, 1C, or 1D) is primarily transferred to the ITB 62.

The secondary-transfer counter roller 63 also serves as a driving roller. The ITB 62 rotates in the rotation direction (direction indicated by the arrow R2) along with the rotation of the secondary-transfer counter roller 63. The rotation speed of the ITB 62 is set to be substantially equal to the rotation speed (process speed) of each of the photosensitive drums 1 (1A, 1B, 1C, and 1D).

A secondary transfer roller 64 as a secondary transfer unit is disposed on the surface of the ITB 62 at a position corresponding to the secondary-transfer counter roller 63. The ITB 62 is sandwiched between the secondary-transfer counter roller 63 and the secondary transfer roller 64. As a result, a secondary transfer nip section T2 as a secondary transfer section is formed between the secondary transfer roller 64 and the ITB 62.

A belt cleaner 67 as an intermediate transfer member cleaner abuts the surface of the ITB 62 at a position corresponding to the tension roller 66. The belt cleaner 67 collects the toner that has not been secondarily transferred to a recording medium but has remained on the ITB 62.

Recording media (e.g., sheets such as paper or transparent films) on which an image is to be formed by the image forming units P (Pa, Pb, Pc, and Pd) are stacked and stored in a sheet cassette as a sheet storage unit. The recording media taken out from the sheet cassette by a pickup roller are then separated one by one by a separation roller and fed to a registration roller. The registration roller feeds the recording medium to the secondary transfer nip section T2 in synchronization with the toner image on the ITB 62.

A fixing device 7 including a fixing unit and a pressurizing unit is disposed on the downstream side of the secondary transfer nip section T2 in the conveyance direction of the recording medium. Furthermore, a discharge tray on which the recording medium discharged outside the apparatus is stacked is disposed on the downstream side of the fixing device 7 in the conveyance direction of the recording medium. The recording medium on which the toner image has been transferred is heated and pressed by the fixing device 7, whereby the toner image is fixed on the surface of the recording medium. The recording medium having the toner image fixed on the surface thereof is then discharged to the discharge tray.

(Configuration of Developing Device)

Next, the configuration of the developing device 4 will be described with reference to a schematic view of FIG. 2 and a cross-sectional view of FIG. 3.

The developing device 4 includes a developing container 44 that stores a developer. In the developing container 44, a developing sleeve 41 and a developing blade 43 are disposed. The developing sleeve 41 serves as a developer carrying member that carries a developer (two-component developer). The developing blade 43 serves as a developer regulation member that regulates the amount of the developer to be carried on the surface of the developing sleeve 41.

The developing blade 43 functions to form a thin layer of the developer on the surface of the developing sleeve 41. Note that the developing blade 43 may be a developing blade molded of a resin material or a developing blade made of a metallic material such as stainless steel (SUS).

In the first exemplary embodiment, the developing sleeve 41 includes aluminum, which is a non-magnetic material. Note that the developing sleeve 41 may include stainless steel as long as the material is a non-magnetic material. Note that in the first exemplary embodiment, to reduce the size of the developing device 4, the diameter of the developing sleeve 41 is set to 18 mm (φ18) or less.

Inside the developing sleeve 41, a magnet 42 (magnet for two-component development) as a magnetic field generation unit having a plurality of magnetic poles is fixedly arranged along the circumferential direction of the developing sleeve 41. In the first exemplary embodiment, the magnet 42 includes a plurality of magnet pieces (a first magnet portion 42*a*, a second magnet portion 42*b*, a third magnet portion 42*c*, a fourth magnet portion 42*d*, and a fifth magnet portion 42*e*).

The developing sleeve 41 rotates counterclockwise (in the direction indicated by an arrow R41 illustrated in FIG. 3) around the outer peripheral portion of the magnet 42. A developer carrying region, which is a region where the developer is carried on the developing sleeve 41 in the axial direction of a rotation axis of the developing sleeve (hereinbelow referred to as a longitudinal direction of the developing sleeve 41), is substantially equal to the width of the magnet 42 in the longitudinal direction.

In the developing container 44, a developing chamber 44*a* and an agitating chamber 44*b* are disposed side by side in the horizontal direction. In addition, a partition wall 47 for partitioning the developing chamber 44*a* and the agitating chamber 44*b* is provided in the developing container 44. The developer separated from the developing sleeve 41 is collected in the developing chamber 44*a*. Then, the developer collected in the developing chamber 44*a* is supplied again to the developing sleeve 41 in the developing chamber 44*a*.

In the longitudinal direction of the developing sleeve 41, an opening is provided in the developing chamber 44*a* at a position corresponding to a region where the developing sleeve 41 faces the photosensitive drum 1 (hereinbelow referred to as a development region). At this opening, the developing sleeve 41 is rotatably arranged so that a part of the developing sleeve 41 is exposed.

A first conveying screw 45*a* as a first developer conveying member that agitates and conveys the developer in the developing chamber 44*a* is rotatably provided in the developing chamber 44*a*. In addition, a second conveying screw 45*b* as a second developer conveying member that agitates and conveys the developer in the agitating chamber 44*b* is rotatably provided in the agitating chamber 44*b*. The second conveying screw 45*b* agitates and conveys the developer supplied by a developer replenishing mechanism (hopper) for replenishing the developer and the developer already existing in the agitating chamber 44*b*. The first conveying screw 45*a* and the second conveying screw 45*b* convey the developer in the opposite directions to each other and circulate the developer in the developing container 44 through a circulation path of the developer.

Figure 2:
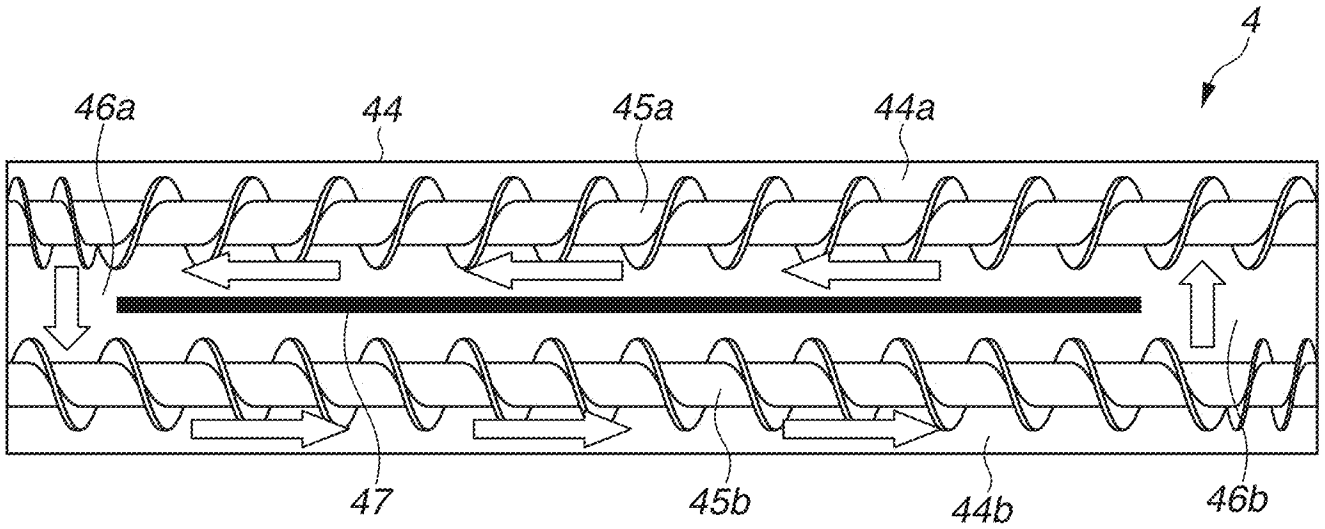
FIG. 2 is a schematic view illustrating a configuration of a developing device according to the first exemplary embodiment.

As illustrated in FIG. 2, the developer conveyed by the first conveying screw 45*a* is delivered from the developing chamber 44*a* to the agitating chamber 44*b* via a communicating section 46*a*. Furthermore, the developer conveyed by the second conveying screw 45*b* is delivered from the agitating chamber 44*b* to the developing chamber 44*a* via another communicating section 46*b*.

The developer stored in the developing container 44 is a two-component developer in which a negatively chargeable non-magnetic toner and a magnetic carrier are mixed. The non-magnetic toner is powder obtained by including a colorant, a wax component and the like in a resin such as polyester or styrene, and then grinding or polymerizing the resultant mixture. The magnetic carrier is obtained by applying a resin coating to a surface layer of a core including resin particles obtained by kneading ferrite particles or magnetic powder.

(Development Step)

Next, a process in which an electrostatic latent image on the surface of the photosensitive drum 1 is developed (development step) will be described.

The surface of the photosensitive drum 1 is uniformly charged to a charging potential (dark portion potential) Vd [V] by the charger 2. Thereafter, a portion corresponding to the image portion on the surface of the photosensitive drum 1 is exposed by the exposure device 3 to have an exposure potential (light portion potential) V1 [V]. A DC voltage or a voltage obtained by superimposing an alternating current (AC) voltage on the DC voltage is applied to the developing sleeve 41. When the voltage of the DC component of the developing sleeve 41 is Vdc, an absolute value |Vdc−V1| of a difference between the voltage of the DC component of the developing sleeve 41 and the exposure potential is referred to as Vcont. An electric field for transporting the toner to the image portion on the surface of the photosensitive drum 1 is formed by this Vcont. In addition, an absolute value |Vdc−Vd| of a difference between the voltage Vdc of the DC component of the developing sleeve 41 and the charging potential Vd is referred to as Vback. An electric field for pulling back the toner from the surface of the photosensitive drum 1 toward the developing sleeve 41 is formed by this Vback.

When the diameter of the developing sleeve 41 decreases along with the downsizing of the developing device 4, the magnet 42 inside the developing sleeve 41 becomes smaller than when the developing sleeve 41 has a larger diameter. As a result, the distance between the magnetic poles in the rotation direction of the developing sleeve 41 becomes short and the peel-off region becomes narrow. This tends to make it difficult for the developer subjected to development to separate from the developing sleeve 41.

A case will be considered where a configuration is adopted in which a new magnet 42 is externally added near a magnetic pole (stripping pole) for separating the developer carried on the surface of the developing sleeve 41 from the developing sleeve 41. In a case where such a configuration is adopted, a space for arranging a new magnet is required outside the developing sleeve 41, leading to an increase in the size of the developing device. Accordingly, in the developing device 4 using the developing sleeve 41 having a small diameter, it is desirable to improve peelability of the developer near the stripping pole and to reduce the size of the developing device, by adjusting a magnetic force pattern near the stripping pole without arranging a new magnet outside the developing sleeve 41.

In the first exemplary embodiment, the magnetic force pattern near the magnetic pole (stripping pole) for separating the developer carried on the surface of the developing sleeve 41 from the developing sleeve 41 is adjusted with a simple configuration, whereby the peelability of the developer near the stripping pole is improved. Details of this configuration will be described below.

The configuration of the magnet 42 according to the first exemplary embodiment will be described with reference to a schematic view of FIG. 4. In the first exemplary embodiment, as illustrated in FIG. 3, a groove 48 is provided in the fifth magnet portion 42*e* over the entire region of the magnet 42 in the longitudinal direction thereof. The fifth magnet portion 42*e* is arranged on the downstream side of the fourth magnet portion 42*d* in the rotation direction of the developing sleeve 41 (direction indicated by R41 illustrated in FIG. 3).

The stripping pole formed by the fifth magnet portion 42*e* has two local maximums of the same polarity at an N3 pole and an N4 pole. Of the two local maximums, the local maximum on the upstream side is at the N3 pole and the local maximum on the downstream side is at the N4 pole.

The developer is peeled off at a peel-off region formed between the stripping pole N4 and a magnetic pole (pumping pole) N1 having the same polarity as the stripping pole N4 and attracting the developer to the developing sleeve 41. In addition, in the first exemplary embodiment, since the stripping pole has two local maximums of the same polarity at the N3 pole and the N4 pole, a preliminary peel-off region where the developer hardly exists is formed between the two poles (region with a weak force for attracting the developer to the developing sleeve 41).

First, the force with which the developer is attracted to the developing sleeve 41 will be described. The force with which the developer is attracted to the developing sleeve 41 is represented by a magnetic attraction force Fr obtained by the following expression (Expression 1).

$$F_r = \frac{\mu - \mu_0}{\mu_0(\mu + 2\mu_0)} 4\pi b^3 \left( B_r \frac{\partial B_r}{\partial r} + B_\theta \frac{\partial B_\theta}{\partial r} \right) \quad (1)$$

In the expression, μ represents the magnetic permeability of the magnetic carrier, $\mu_0$ represents the vacuum permeability, and b represents the radius of the magnetic carrier. Furthermore, Br represents the magnetic flux density of a component in the direction normal to the developing sleeve 41. Using a magnetic field measuring device "MS-9902" (trade name) manufactured by F. W. BELL as a measuring device, Br was measured with the distance between a probe, which is a member of the measuring device, and the surface of the developing sleeve 41 being about 100 μm.

Bθ is obtained from the following expression (Expression 2) using the value of Br measured by the above method.

$$B_\theta = -\frac{\partial A_z(r, \theta)}{\partial r} \left( A_z(R, \theta) = \int_0^\theta R B_r d\theta \right) \quad (2)$$

Bθ can be derived and Fr can be calculated using the value of Br measured in this manner.

Figure 5:
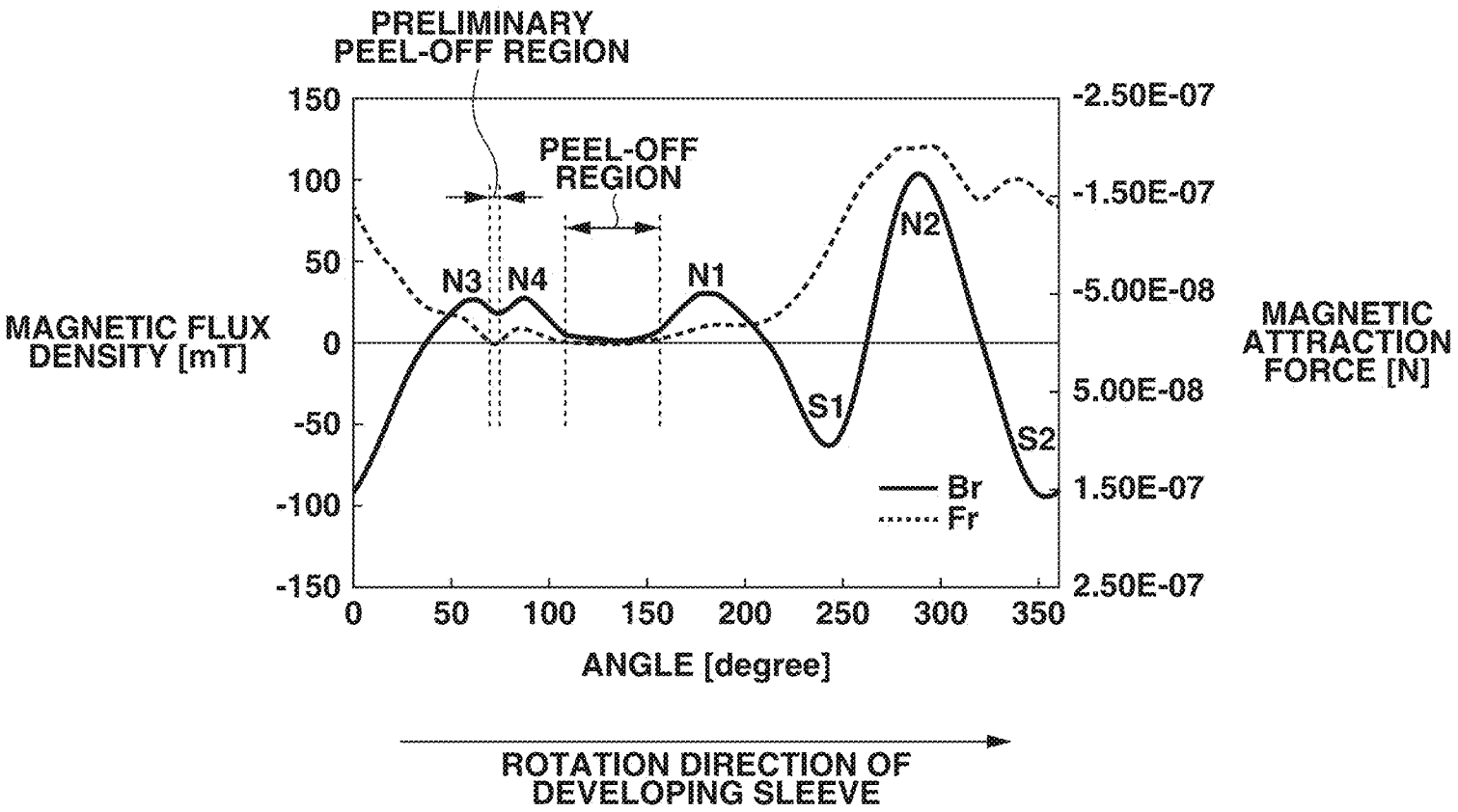
FIG. 5 is a graph illustrating distributions of Br and Fr in the configuration of the magnet according to the first exemplary embodiment.

FIG. 5 illustrates a relationship between Br and Fr of the magnet 42 according to the first exemplary embodiment.

Fr is calculated assuming that the relative permeability of the magnetic carrier is 5 and the radius of the magnetic carrier is 20 μm. As for the angle plotted on the horizontal axis in the graph, the vertically upward direction is set to 0° and the rotation direction of the developing sleeve 41 is set to be a positive direction.

Focusing on Br indicated by the solid line in FIG. 5, there is a region where Br decreases between the N4 pole (stripping pole) and the N1 pole (pumping pole). This is due to a repulsive force generated by a repulsive magnetic field formed between the N4 pole and the N1 pole. In this region, Fr indicated by the dotted line in FIG. 5 also becomes small. Fr represents the force acting in the direction normal to the developing sleeve 41 among the forces acting on the magnetic carrier. Therefore, the force for attracting the magnetic carrier toward the center of the developing sleeve 41 is represented by a negative value of Fr. In other words, in the region between the N4 pole and the N1 pole where Fr is small, the force for attracting the developer toward the developing sleeve 41 does not work, and this region serves as the peel-off region.

Furthermore, Br on the upstream side of the peel-off region in the rotation direction of the developing sleeve 41 includes a maximum peak position of the N3 pole where Br of the N3 pole is maximal and a maximum peak position of the N4 pole where Br of the N4 pole is maximal. In addition, there is a minimum peak position, where Br is minimal, immediately downstream of the maximum peak position of the N3 pole and immediately upstream of the maximum peak position of the N4 pole in the rotation direction of the developing sleeve 41. In the region having the two local maximums of the N3 pole and the N4 pole at the maximum peak positions, Fr drops between the N3 pole and the N4 pole. This is caused by repulsion between the N3 pole and the N4 pole. In this region, it is difficult for the developer to be carried on the developing sleeve 41. In other words, this region corresponds to the preliminary peel-off region, since the developer is peeled from the developing sleeve 41 before the peel-off region.

In the first exemplary embodiment, to enhance the preliminary peel-off effect in the preliminary peel-off region, the magnetic force pattern near the stripping pole is adjusted in such a manner that the ratio of the magnitude of the local minimum between the N3 pole and the N4 pole to the magnitude of the local maximum of the N3 pole is more than 30% and less than 95%.

The ratio of the magnitude of the local minimum between the N3 pole and the N4 pole to the magnitude of the local maximum of the N3 pole is set to 30% as follows. Specifically, the ratio of the cross-sectional area of the groove 48 to the sum of the cross-sectional area of the magnet portion 42*e* and the cross-sectional area of the groove 48 in the cross section orthogonal to the rotation axis of the developing sleeve 41 is set to 22.2%. In other words, the ratio of the cross-sectional area of the groove 48 to the sum of the cross-sectional area of the entire magnet 42 and the cross-sectional area of the groove 48 in the cross section orthogonal to the rotation axis of the developing sleeve 41 is set to 5.6%.

Meanwhile, the ratio of the magnitude of the local minimum between the N3 pole and the N4 pole to the magnitude of the local maximum of the N3 pole is set to 95% as follows. Specifically, the ratio of the cross-sectional area of the groove 48 to the sum of the cross-sectional area of the magnet portion 42*e* and the cross-sectional area of the groove 48 in the cross section orthogonal to the rotation axis of the developing sleeve 41 is set to 1.6%. In other words, the ratio of the cross-sectional area of the groove 48 to the sum of the cross-sectional area of the entire magnet 42 and the cross-sectional area of the groove 48 in the cross section orthogonal to the rotation axis of the developing sleeve 41 is set to 0.4%.

Therefore, the ratio of the magnitude of the local minimum between the N3 pole and the N4 pole to the magnitude of the local maximum of the N3 pole is set to more than 30% and less than 95% as follows. Specifically, the ratio of the cross-sectional area of the groove 48 to the sum of the cross-sectional area of the magnet portion 42*e* and the cross-sectional area of the groove 48 in the cross section orthogonal to the rotation axis of the developing sleeve 41 is set to more than 1.6% and less than 22.2%. In other words, the ratio of the cross-sectional area of the groove 48 to the sum of the cross-sectional area of the entire magnet 42 and the cross-sectional area of the groove 48 in the cross section orthogonal to the rotation axis of the developing sleeve 41 is set to more than 0.4% and less than 5.6%.

Meanwhile, if the magnitude of the local minimum between the N3 pole and the N4 pole is too small relative to the magnitude of the local maximum of the N3 pole, the preliminary peel-off effect increases but the balance of the repulsive forces between the N3 pole or the N4 pole and the N1 pole may be deteriorated and the peel-off region may be narrowed.

Accordingly, to sufficiently peel off the developer from the developing sleeve 41 in each of the preliminary peel-off region and the peel-off region, the ratio of the magnitude of the local minimum between the N3 pole and the N4 pole to the magnitude of the local maximum of the N3 pole is more desirably more than 50% and less than 95%.

The ratio of the magnitude of the local minimum between the N3 pole and the N4 pole to the magnitude of the local maximum of the N3 pole is set to 50% as follows. Specifically, the ratio of the cross-sectional area of the groove 48 to the sum of the cross-sectional area of the magnet portion 42*e* and the cross-sectional area of the groove 48 in the cross section orthogonal to the rotation axis of the developing sleeve 41 is set to 15.8%. In other words, the ratio of the cross-sectional area of the groove 48 to the sum of the cross-sectional area of the entire magnet 42 and the cross-sectional area of the groove 48 in the cross section orthogonal to the rotation axis of the developing sleeve 41 is set to 4.0%.

Therefore, the ratio of the magnitude of the local minimum between the N3 pole and the N4 pole to the magnitude of the local maximum of the N3 pole is set to the more desirable range of more than 50% and less than 95% as follows. Specifically, the ratio of the cross-sectional area of the groove 48 to the sum of the cross-sectional area of the magnet portion 42*e* and the cross-sectional area of the groove 48 in the cross section orthogonal to the rotation axis of the developing sleeve 41 is set to more than 1.6% and less than 15.8%. In other words, the ratio of the cross-sectional area of the groove 48 to the sum of the cross-sectional area of the entire magnet 42 and the cross-sectional area of the groove 48 in the cross section orthogonal to the rotation axis of the developing sleeve 41 is set to more than 0.4% and less than 4.0%.

Note that in the first exemplary embodiment, the ratio of the magnitude of the local minimum between the N3 pole and the N4 pole to the magnitude of the local maximum of the N3 pole is set to 70% as follows. Specifically, the ratio of the cross-sectional area of the groove 48 to the sum of the cross-sectional area of the magnet portion 42*e* and the cross-sectional area of the groove 48 in the cross section orthogonal to the rotation axis of the developing sleeve 41 is set to 9.5%. In other words, the ratio of the cross-sectional area of the groove 48 to the sum of the cross-sectional area of the entire magnet 42 and the cross-sectional area of the groove 48 in the cross section orthogonal to the rotation axis of the developing sleeve 41 is set to 2.4%.

In other words, a certain amount of the developer is peeled off in the preliminary peel-off region on the upstream side of the peel-off region, formed between the N4 pole and the N1 pole, in the rotation direction of the developing sleeve 41. In addition, the developer which has not been completely peeled off in the preliminary peel-off region is conveyed to the peel-off region along with the rotation of the developing sleeve 41, and then peeled off in the peel-off region. The developer can undergo two peeling steps, i.e., the peeling step in the preliminary peel-off region and the peeling step in the peel-off region. Therefore, a peeling failure in which the developer subjected to development does not sufficiently separate from the developing sleeve 41 is suppressed.

In order to obtain such two peel-off regions so that the developer can undergo the two peeling steps including the peeling step in the preliminary peel-off region and the peeling step in the peel-off region, Fr near the N4 pole needs to be large to some extent. The absolute value of Fr forming the peel-off region where the developer subjected to development is stably peeled from the developing sleeve 41 is 1 [nN] or less. As long as the absolute value of Fr is 10 [nN] or less, however, the developer starts to be peeled from the developing sleeve 41. In order to stably obtain two peel-off regions, therefore, the absolute value of Fr near the N4 pole needs to be 10 [nN] or more (in this case, the absolute value of Fr at the maximum peak position of the N4 pole where Br is maximal is 10 [nN] or more). Therefore, to make the absolute value of Fr near the N4 pole be 10 [nN] or more, it is necessary to satisfy the following conditions.

First, the maximum peak position of the N4 pole where Br is maximal is on the downstream side of the maximum peak position of the N3 pole where Br of the N3 pole is maximal and on the upstream side of the maximum peak position of the N1 pole where Br of the N1 pole is maximal in the rotation direction of the developing sleeve 41. Second, the minimum peak position (also referred to as local minimum point) where Br is minimal is on the downstream side of the maximum peak position of the N3 pole and on the upstream side of the maximum peak position of the N4 pole in the rotation direction of the developing sleeve 41. Third, Br at the maximum peak position of the N4 pole is 120% or more larger than Br at the minimum peak position on the downstream side of the maximum peak position of the N3 pole and on the upstream side of the maximum peak position of the N4 pole in the rotation direction of the developing sleeve 41.

Accordingly, in the first exemplary embodiment, Br at the maximum peak position of the N4 pole is 27.3 [mT], and Br at the minimum peak position on the downstream side of the maximum peak position of the N3 pole and on the upstream side of the maximum peak position of the N4 pole in the rotation direction of the developing sleeve 41 is 18.4 [mT]. In other words, in the first exemplary embodiment, Br at the maximum peak position of the N4 pole is about 150% larger than Br at the minimum peak position on the downstream side of the maximum peak position of the N3 pole and on the upstream side of the maximum peak position of the N4 pole in the rotation direction of the developing sleeve 41.

Figure 9:
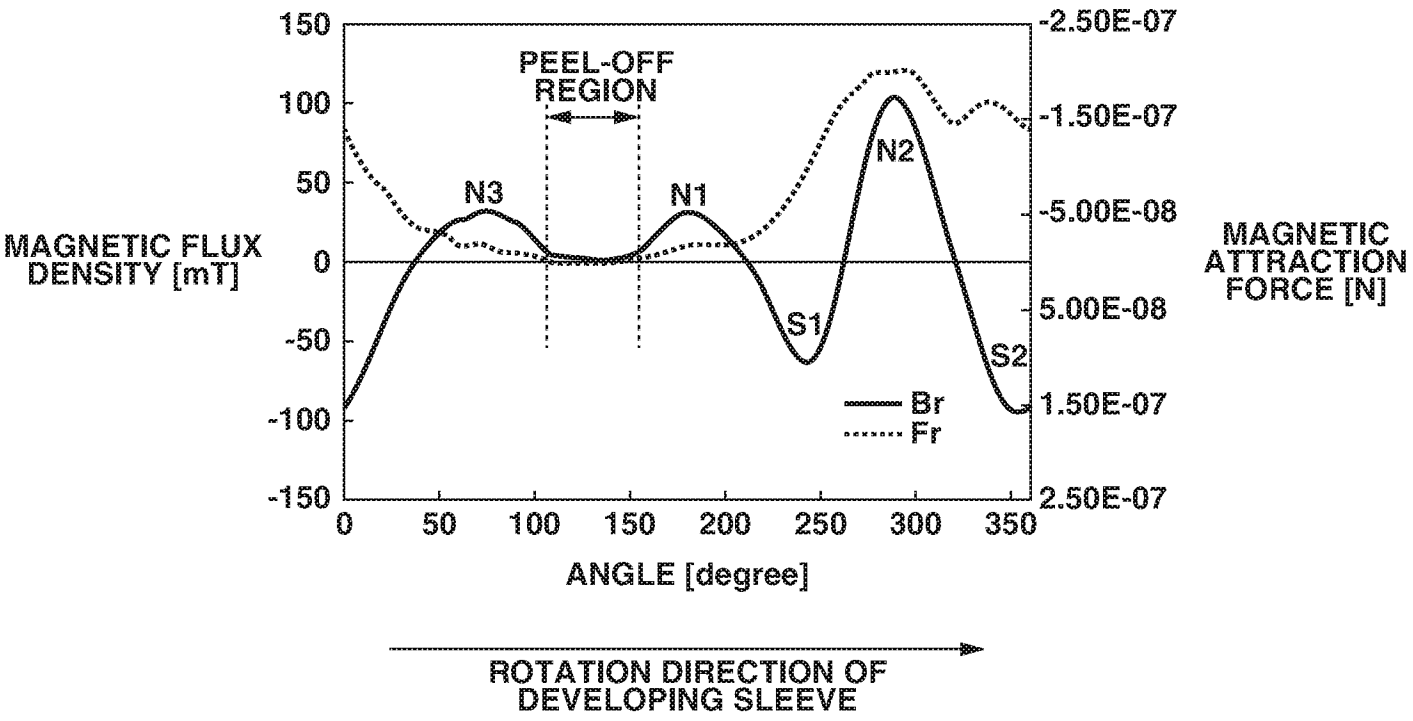
PRIOR ART FIG.9
FIG. 9 is a graph illustrating distributions of Br and Fr in a configuration of a conventional magnet.

As a comparative example, a magnet 42 in which the groove 48 is not formed in the fifth magnet portion 42*e* was used. FIG. 9 illustrates the distributions of Br and Fr in the configuration of the magnet 42 according to the comparative example. As the comparative example, FIG. 9 illustrates the distributions of Br and Fr in the configuration in which the groove 48 is not provided in the fifth magnet portion 42*e* that forms the stripping pole, and the stripping pole has one local maximum N3.

In the comparative example, the stripping pole has one local maximum N3. The magnetic pole formed by the fifth magnet portion 42*e* does not have a local minimum point (minimum peak position), and there is one local maximum at the N3 pole. In the comparative example, Fr on the upstream side of the peel-off region in the rotation direction of the developing sleeve 41 does not become as low as Fr illustrated in the first exemplary embodiment, and the peeling of the developer occurs in the peel-off region.

In order to ascertain the effect of the first exemplary embodiment, a solid image of A4 size was printed on ten consecutive sheets and a decrease in the image density at this time was measured, in each of the case of using the configuration of the magnet 42 according to the first exemplary embodiment and the case of using the configuration of the magnet 42 according to the comparative example. The density value was measured using a reflection spectrodensitometer 500 series (trade name) manufactured by X-Rite Inc., and a value obtained by averaging the values of ten points in the main scanning direction at the center in the sub scanning direction of the output image was adopted as the density value.

The difference in the value of reflectance density between the first sheet and the tenth sheet is defined as Δ. In this case, the value of Δ was 0.22 in the case of using the configuration of the magnet 42 according to the comparative example, while the value of Δ was 0.02, which was a much better value than that of the comparative example, in the case of using the configuration of the magnet 42 according to the first exemplary embodiment.

The width of the non-magnetic band (region where the absolute value of Br is 5 mT or less) is about 42° in each of the comparative example and the first exemplary embodiment, and the peel-off region where Fr is small (region where Fr is −1 nN or more, in other words, the magnetic force region where the absolute value of Fr is 1 nN or less) has a similar width. Therefore, it can be said that the peeling action of the developer in the peel-off region is equal between both cases. In other words, this improvement in preventing the decrease in density is achieved because the developer has undergone the two peeling steps including the peeling step in the preliminary peel-off region and the peeling step in the peel-off region, which are implemented by providing the preliminary peel-off region before the peel-off region. Therefore, the peeling failure in which the developer subjected to development does not sufficiently separate from the developing sleeve 41 is suppressed.

Figure 6:
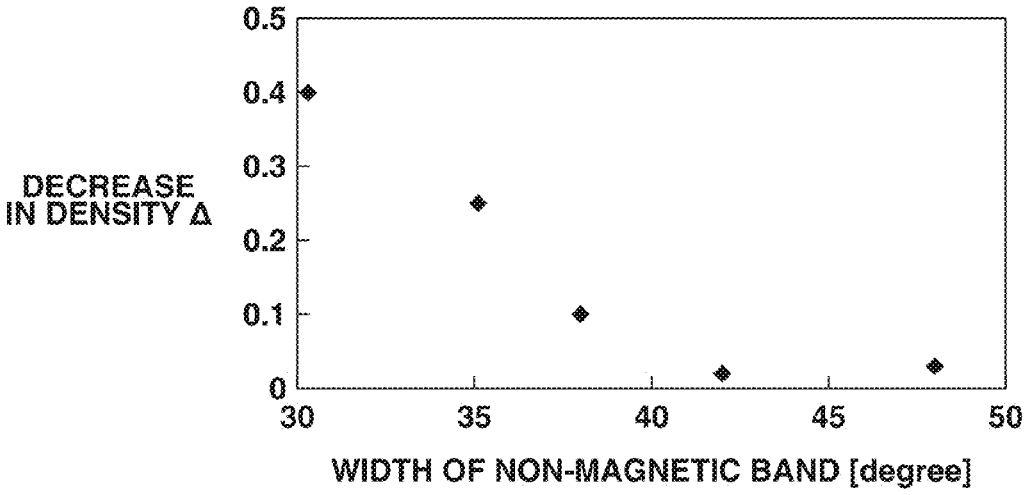
FIG. 6 is a graph illustrating a relationship between a width of a non-magnetic band and a decrease in density.

FIG. 6 illustrates the difference Δ in the value of reflectance density between the first sheet and the tenth sheet when the width of the non-magnetic band is changed in the configuration provided with the preliminary peel-off region similarly to the first exemplary embodiment.

As illustrated in FIG. 6, the density starts to decrease when the width of the non-magnetic band falls below 40° and, when the width is 35°, the difference Δ is 0.21, indicating a non-negligible decrease in density. This indicates that the developer that has not been completely peeled off in the preliminary peel-off region is not peeled off even in the peel-off region. For this reason, to improve the peelability of the developer, the width of the peel-off region is desirably 35° or more, more desirably 40° or more.

In the first exemplary embodiment, as illustrated in FIG. 5, the magnitude of the local maximum N3 and the magnitude of the local maximum N4 are substantially the same. In a second exemplary embodiment, on the other hand, the magnetic force pattern near the stripping pole is adjusted and optimized so that the magnitude of the local maximum N3 is larger than the magnitude of the local maximum N4. This is for further enhancing the peel-off effect of the developer from the developing sleeve 41 in the preliminary peel-off region.

In the first exemplary embodiment, the change in Fr illustrated in FIG. 5 indicates that Fr rises again on the downstream side of the preliminary peel-off region in the rotation direction of the developing sleeve 41. This is mainly Fr created by the attraction force of the N4 pole. If Fr in this section is large, when the developer is conveyed from the N3 pole to the preliminary peel-off region, the amount of the developer that is not peeled off in the preliminary peel-off region but attracted to the N4 pole increases. Therefore, from this point of view, Fr near the N4 pole is desirably small.

There are two methods for weakening Fr near the N4 pole. The first method is to decrease Br of the N4 pole. It can be seen from Expressions 1 and 2 described above that Fr becomes smaller by decreasing the absolute value of Br. However, simply decreasing Br of the N4 pole increases the preliminary peel-off effect but may deteriorate the balance of the repulsive forces between the N3 pole or the N4 pole and the N1 pole and narrow the peel-off region.

In addition, as described in the first exemplary embodiment, the absolute value of Fr near the N4 pole needs to be 10 [nN] or more to stably obtain two peel-off regions. To this end, Br at the maximum peak position of the N4 pole needs to be 120% or more larger than Br at the minimum peak position on the downstream side of the maximum peak position of the N3 pole and on the upstream side of the maximum peak position of the N4 pole in the rotation direction of the developing sleeve 41.

This makes it necessary to decrease Fr near the N4 pole while maintaining the balance of the repulsive forces between the N3 pole or N4 pole and the N1 pole and keeping Br at the maximum peak position of the N4 pole 120% or more larger than Br at the minimum peak position between the N3 pole and the N4 pole. Accordingly, it is only necessary to increase Br at the maximum peak position of the N3 pole while setting Br at the maximum peak position of the N4 pole to necessary minimum Br, in such a manner that Br at the maximum peak position of the N4 pole is 120% or more larger than Br at the minimum peak position between the N3 pole and the N4 pole. At this time, the magnitude of Br at the maximum peak position of the N3 pole is made larger than the magnitude of Br at the maximum peak position of the N4 pole.

In the second method, as indicated by Expression 1, it is found that Fr increases as Br changes more sharply. In order to decrease Fr, therefore, the local minimum point (minimum peak position) between the N3 pole and the N4 pole should be close to the N3 pole (the upstream side in the rotation direction of the developing sleeve 41) so that Br near the N4 pole gently changes.

The shape and position of the groove 48 provided in the fifth magnet portion 42*e* were changed from those in the first exemplary embodiment to conform to the above two methods, and as indicated in Table 1, the values of Br at the N3 pole and the N4 pole and the position of the local minimum point were adjusted.

TABLE 1

| | First exemplary embodiment | | Second exemplary embodiment | |
|---|---|---|---|---|
| | Br [mT] | Position [°] | Br [mT] | Position [°] |
| N3 pole | 26.7 | 62 | 33.8 | 61 |
| Local minimum point | 18.4 | 74 | 19.0 | 66 |
| N4 pole | 27.3 | 87 | 25.5 | 86 |

In the second exemplary embodiment, Br of the N3 pole is increased and Br of the N4 pole is decreased as compared to the first exemplary embodiment. In the first exemplary embodiment, the position of the local minimum point is substantially at the center between the N3 pole and the N4 pole. In the second exemplary embodiment, on the other hand, the position of the local minimum point is shifted toward the N3 pole (the upstream side in the rotation direction of the developing sleeve 41) by about 7°.

Figure 7:
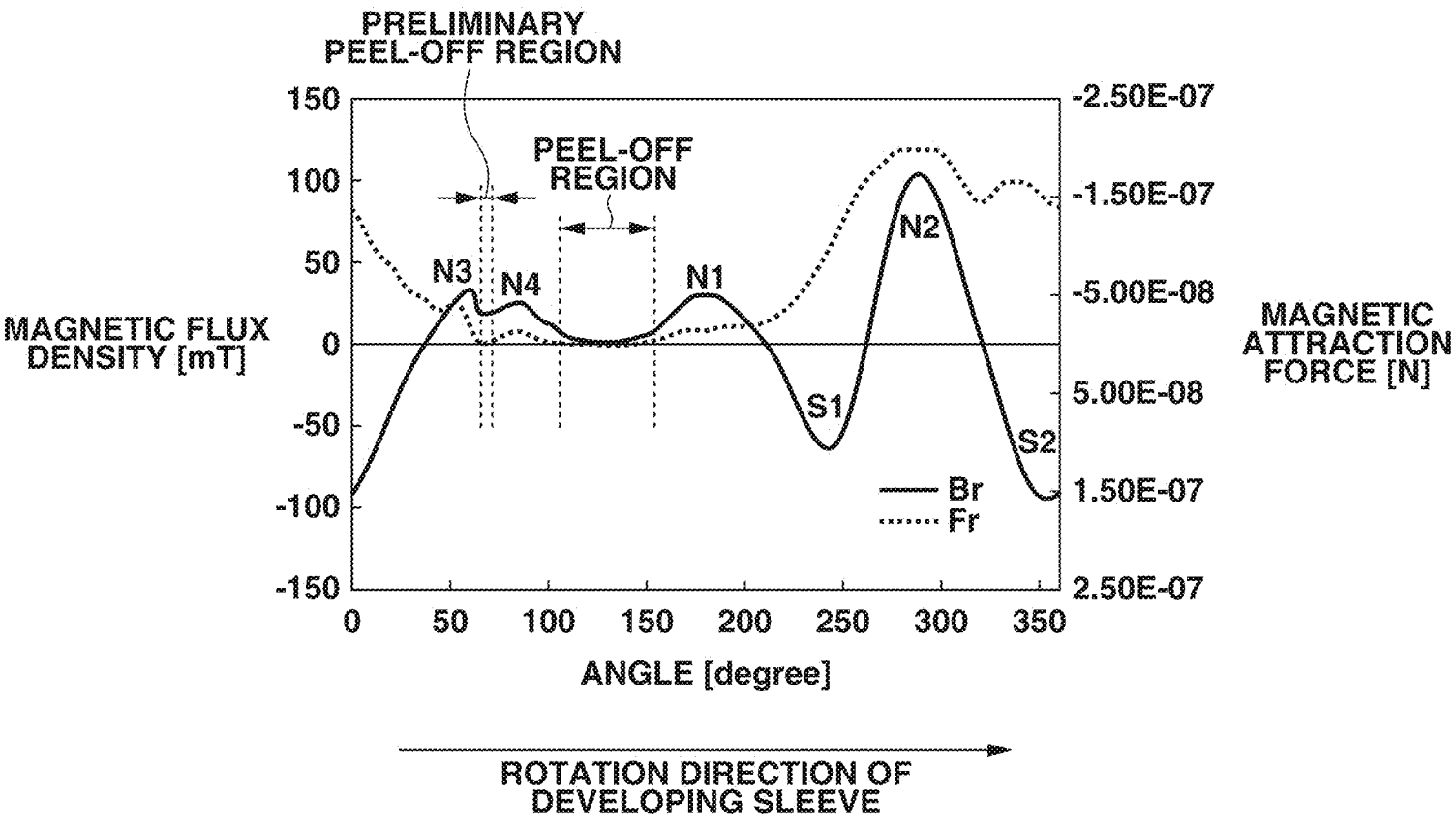
FIG. 7 is a graph illustrating distributions of Br and Fr in a configuration of a magnet according to a second exemplary embodiment.
Figures 8A, 8B:
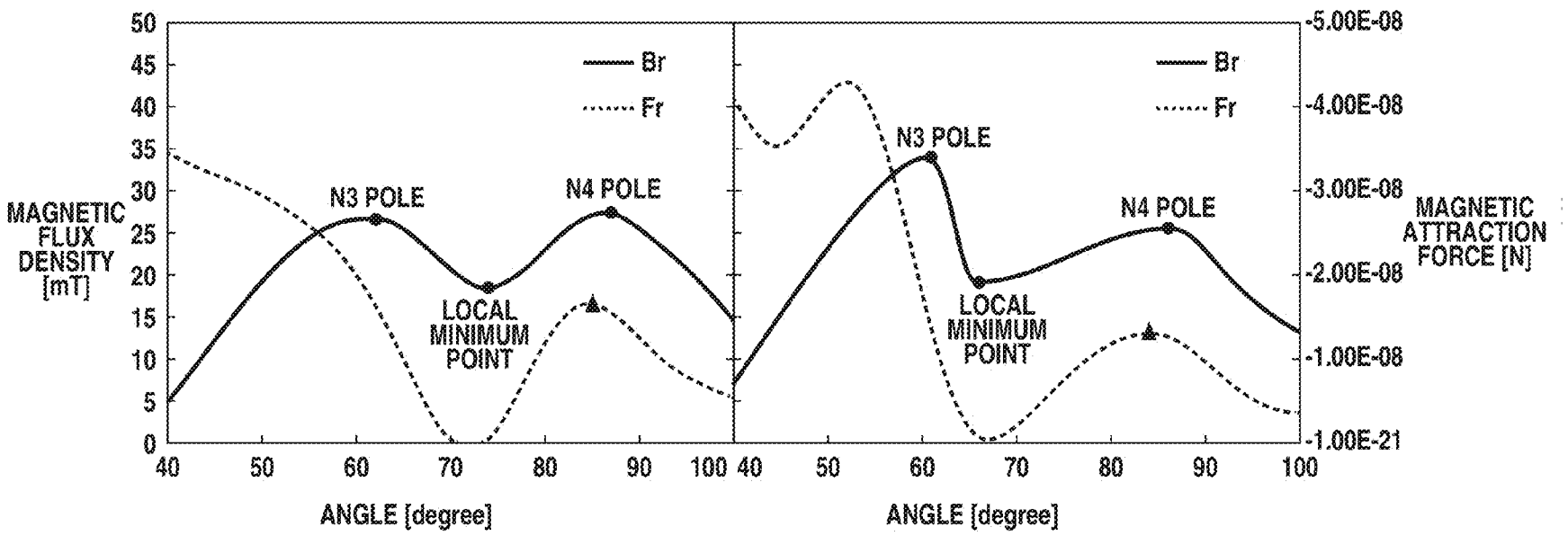
FIGS. 8A and 8B are graphs illustrating the distributions of Br and Fr near a stripping pole.

FIG. 7 illustrates the distributions of Br and Fr in the configuration of the magnet 42 according to the second exemplary embodiment. FIGS. 8A and 8B are enlarged graphs of the periphery of the stripping pole (the range of 40° to 100° in the rotation direction of the developing sleeve 41). FIG. 8A is the graph obtained using the configuration of the magnet 42 according to the first exemplary embodiment. Meanwhile, FIG. 8B is the graph obtained using the configuration of the magnet 42 according to the second exemplary embodiment.

In the second exemplary embodiment, as illustrated in FIG. 8B, the value of Fr near the N4 pole increases (the force of attracting the developer to the developing sleeve 41 decreases). Specifically, in FIGS. 8A and 8B, the local maximum of Fr near the N4 pole indicated by the triangle is −16.5×10 nN in the first exemplary embodiment and −12.9 nN in the second exemplary embodiment.

In this manner, by optimizing the relationship between Br of the N3 pole and the N4 pole and the local minimum point (minimum peak position) therebetween, Fr near the N4 pole can be decreased. As a result, in the second exemplary embodiment, the peeling amount in the preliminary peel-off region is increased and the peeling failure is further suppressed.

Aspects of the present invention are not limited to the above-described exemplary embodiments, and various modifications (including organic combinations of the respective exemplary embodiments) are possible based on the spirit of the present invention. These modifications are not excluded from the scope of the present invention.

In the above exemplary embodiments, as illustrated in FIG. 1, the image forming apparatus using the ITB 62 as an image bearing member has been described as an example, but aspects of the present invention are not limited to this example. Aspects of the present invention are also applicable to an image forming apparatus with a configuration in which an image is transferred by bringing a recording medium into direct contact with the photosensitive drums 1 (1A, 1B, 1C, and 1D) sequentially. In that case, the photosensitive drums 1 (1A, 1B, 1C, and 1D) constitute a rotatable image bearing member that bears a toner image.

Figure 3:
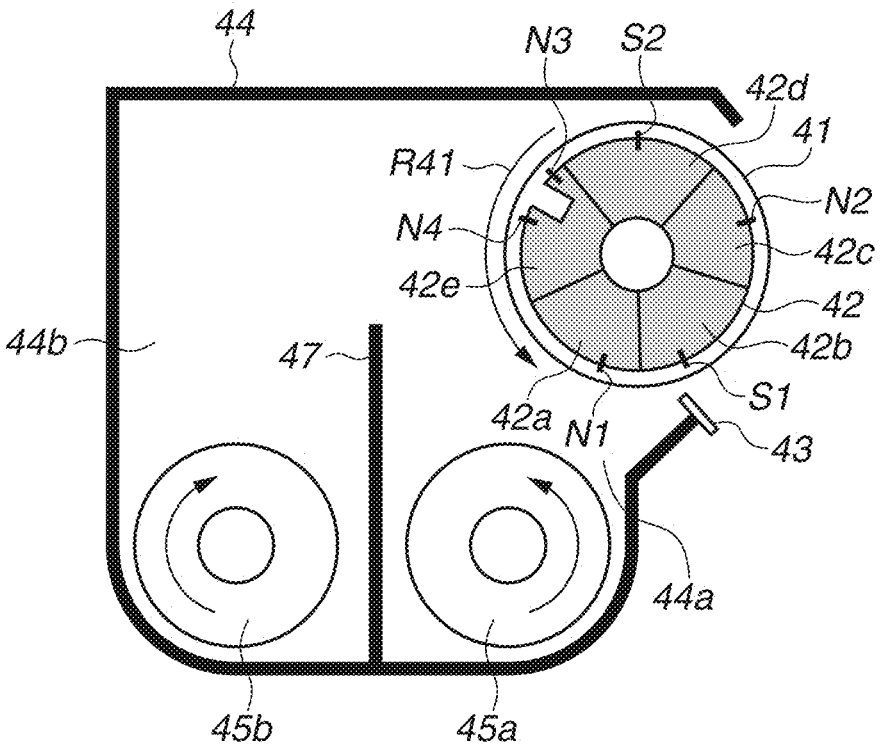
FIG. 3 is a cross-sectional view illustrating the configuration of the developing device according to the first exemplary embodiment.
Figure 4:
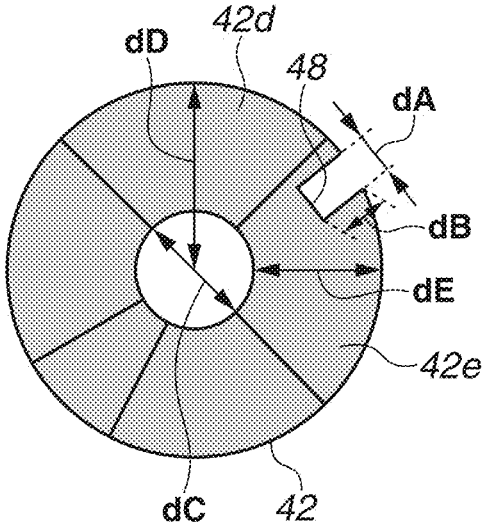
FIG. 4 is a schematic view illustrating a configuration of a magnet according to the first exemplary embodiment.

In the above exemplary embodiments, the exemplary configuration of the developing device 4 has been described in which, as illustrated in FIG. 3, the developing sleeve 41 rotates counterclockwise (direction indicated by the arrow R41 illustrated in FIG. 3) and the developing blade 43 is disposed below the developing sleeve 41. However, aspects of the present invention are not limited to this configuration. Aspects of the present invention are also applicable to the developing device 4 having a configuration in which the developing sleeve 41 rotates clockwise and the developing blade 43 is disposed above the developing sleeve 41.

In the above exemplary embodiments, the exemplary configuration of the developing device 4 has been described in which, as illustrated in FIG. 3, the developing chamber 44*a* and the agitating chamber 44*b* are disposed side by side in the horizontal direction. However, aspects of the present invention are not limited to this configuration. Aspects of the present invention are also applicable to the developing device 4 having a configuration in which the developing chamber 44*a* and the agitating chamber 44*b* are disposed vertically in the direction of gravity.

While aspects of the present invention have been described with reference to exemplary embodiments, it is to be understood that aspects of the invention are not limited to the disclosed exemplary embodiments. The scope of the following claims is to be accorded the broadest interpretation so as to encompass all such modifications and equivalent structures and functions.

This application claims the benefit of Japanese Patent Applications No. 2016-177989, filed Sep. 12, 2016, and No. 2017-132909, filed Jul. 6, 2017, which are hereby incorporated by reference herein in their entirety.

What is claimed is:

1. A developing device comprising:

a developer carrying member rotatably provided and configured to carry a developer containing a toner and a magnetic carrier for developing an electrostatic latent image formed on an image bearing member; and a magnet fixedly arranged inside the developer carrying member and including a first magnetic pole and a second magnetic pole arranged adjacent to the first magnetic pole in a rotation direction of the developer carrying member and having same polarity as the first magnetic pole, the magnet being configured to generate a magnetic field for peeling off, from a surface of the developer carrying member, the developer which has passed through a development region facing the image bearing member, wherein a groove is provided in the magnet over an entire region of the magnet in a longitudinal direction thereof to satisfy the following (i) to (iii):

(i) a third maximum peak position where a magnetic flux density of a component in a direction normal to the developer carrying member becomes maximal is on the surface of the developer carrying member on a downstream side of a first maximum peak position where the magnetic flux density of the component in the direction normal to the developer carrying member at the first magnetic pole becomes maximal and on an upstream side of a second maximum peak position where the magnetic flux density of the component in the direction normal to the developer carrying member at the second magnetic pole becomes maximal in the rotation direction of the developer carrying member;

(ii) a minimum peak position where the magnetic flux density of the component in the direction normal to the developer carrying member becomes minimal is on the surface of the developer carrying member on the downstream side of the first maximum peak position and on an upstream side of the third maximum peak position in the rotation direction of the developer carrying member, and the magnetic flux density of the component in the direction normal to the developer carrying member at the minimum peak position is more than 30% and less than 95% of the magnetic flux density of the component in the direction normal to the developer carrying member at the first maximum peak position; and (iii) a first magnetic force region where an absolute value of a magnetic force of the component in the direction normal to the developer carrying member is 1 [nN] or less is formed on the surface of the developer carrying member on a downstream side of the third maximum peak position and on the upstream side of the second maximum peak position in the rotation direction of the developer carrying member, and a second magnetic force region where the absolute value of the magnetic force of the component in the direction normal to the developer carrying member is 1 [nN] or less is formed on the surface of the developer carrying member on the downstream side of the first maximum peak position and on the upstream side of the third maximum peak position in the rotation direction of the developer carrying member.

2. The developing device according to claim 1, wherein the absolute value of the magnetic force of the component in the direction normal to the developer carrying member at the third maximum peak position is 10 [nN] or more.

3. The developing device according to claim 1, wherein the magnetic flux density of the component in the direction normal to the developer carrying member at the third maximum peak position is 120% or more of the magnetic flux density of the component in the direction normal to the developer carrying member at the minimum peak position.

4. The developing device according to claim 1, wherein the magnetic flux density of the component in the direction normal to the developer carrying member at the first maximum peak position is larger than the magnetic flux density of the component in the direction normal to the developer carrying member at the third maximum peak position.

5. The developing device according to claim 1, wherein a ratio of a cross-sectional area of the groove to a sum of a cross-sectional area of the magnet and the cross-sectional area of the groove in a cross section orthogonal to a rotation axis of the developer carrying member is more than 0.4% and less than 5.6%.

6. A magnet for two-component development fixedly arranged inside a rotatable developer carrying member, the magnet comprising:

a first magnetic pole; and a second magnetic pole arranged adjacent to the first magnetic pole in a rotation direction of the developer carrying member and having a same polarity as the first magnetic pole, wherein a groove is provided in the magnet over an entire region of the magnet in a longitudinal direction thereof to satisfy the following (i) to (iii):

(i) a third maximum peak position where a magnetic flux density of a component in a direction normal to the developer carrying member becomes maximal is on a surface of the developer carrying member on a downstream side of a first maximum peak position where the magnetic flux density of the component in the direction normal to the developer carrying member at the first magnetic pole becomes maximal and on an upstream side of a second maximum peak position where the magnetic flux density of the component in the direction normal to the developer carrying member at the second magnetic pole becomes maximal in the rotation direction of the developer carrying member;

(ii) a minimum peak position where the magnetic flux density of the component in the direction normal to the developer carrying member becomes minimal is on the surface of the developer carrying member on the downstream side of the first maximum peak position and on an upstream side of the third maximum peak position in the rotation direction of the developer carrying member, and the magnetic flux density of the component in the direction normal to the developer carrying member at the minimum peak position is more than 30% and less than 95% of the magnetic flux density of the component in the direction normal to the developer carrying member at the first maximum peak position; and (iii) a first magnetic force region where an absolute value of a magnetic force of the component in the direction normal to the developer carrying member is 1 [nN] or less is formed on the surface of the developer carrying member on a downstream side of the third maximum peak position and on the upstream side of the second maximum peak position in the rotation direction of the developer carrying member, and a second magnetic force region where the absolute value of the magnetic force of the component in the direction normal to the developer carrying member is 1 [nN] or less is formed on the surface of the developer carrying member on the downstream side of the first maximum peak position and on the upstream side of the third maximum peak position in the rotation direction of the developer carrying member.

7. The magnet according to claim 6, wherein the absolute value of the magnetic force of the component in the direction normal to the developer carrying member at the third maximum peak position is 10 [nN] or more.

8. The magnet according to claim 6, wherein the magnetic flux density of the component in the direction normal to the developer carrying member at the third maximum peak position is 120% or more of the magnetic flux density of the component in the direction normal to the developer carrying member at the minimum peak position.

9. The magnet according to claim 6, wherein the magnetic flux density of the component in the direction normal to the developer carrying member at the first maximum peak position is larger than the magnetic flux density of the component in the direction normal to the developer carrying member at the third maximum peak position.

10. The magnet according to claim 6, wherein a ratio of a cross-sectional area of the groove to a sum of a cross-sectional area of the magnet and the cross-sectional area of the groove in a cross section orthogonal to a rotation axis of the developer carrying member is more than 0.4% and less than 5.6%.

11. A developing device comprising:

a developer carrying member rotatably provided and configured to carry a developer containing a toner and a magnetic carrier for developing an electrostatic latent image formed on an image bearing member; and a magnet fixedly arranged inside the developer carrying member and including a first magnetic pole and a second magnetic pole arranged adjacent to the first magnetic pole in a rotation direction of the developer carrying member and having same polarity as the first magnetic pole, the magnet being configured to generate a magnetic field for peeling off, from a surface of the developer carrying member, the developer which has passed through a development region facing the image bearing member, wherein a groove is provided in the magnet over an entire region of the magnet in a longitudinal direction thereof to satisfy the following (i) to (iii):

(i) a third maximum peak position where a magnetic flux density of a component in a direction normal to the developer carrying member becomes maximal is on the surface of the developer carrying member on a downstream side of a first maximum peak position where the magnetic flux density of the component in the direction normal to the developer carrying member at the first magnetic pole becomes maximal and on an upstream side of a second maximum peak position where the magnetic flux density of the component in the direction normal to the developer carrying member at the second magnetic pole becomes maximal in the rotation direction of the developer carrying member;

(ii) a minimum peak position where the magnetic flux density of the component in the direction normal to the developer carrying member becomes minimal is on the surface of the developer carrying member on the downstream side of the first maximum peak position and on an upstream side of the third maximum peak position in the rotation direction of the developer carrying member, and the magnetic flux density of the component in the direction normal to the developer carrying member at the minimum peak position is more than 30% and less than 95% of the magnetic flux density of the component in the direction normal to the developer carrying member at the first maximum peak position; and (iii) a first magnetic force region where an absolute value of a magnetic force of the component in the direction normal to the developer carrying member is 1 [nN] or less is formed on the surface of the developer carrying member on a downstream side of the third maximum peak position and on the upstream side of the second maximum peak position in the rotation direction of the developer carrying member, and a second magnetic force region where the absolute value of the magnetic force of the component in the direction normal to the developer carrying member is 10 [nN] or less is formed on the surface of the developer carrying member on the downstream side of the first maximum peak position and on the upstream side of the third maximum peak position in the rotation direction of the developer carrying member.

12. The developing device according to claim 11, wherein the absolute value of the magnetic force of the component in the direction normal to the developer carrying member at the third maximum peak position is 10 [nN] or more.

13. The developing device according to claim 11, wherein the magnetic flux density of the component in the direction normal to the developer carrying member at the third maximum peak position is 120% or more of the magnetic flux density of the component in the direction normal to the developer carrying member at the minimum peak position.

14. The developing device according to claim 11, wherein the magnetic flux density of the component in the direction normal to the developer carrying member at the first maximum peak position is larger than the magnetic flux density of the component in the direction normal to the developer carrying member at the third maximum peak position.

15. The developing device according to claim 11, wherein a ratio of a cross-sectional area of the groove to a sum of a cross-sectional area of the magnet and the cross-sectional area of the groove in a cross section orthogonal to a rotation axis of the developer carrying member is more than 0.4% and less than 5.6%.

16. A magnet for two-component development fixedly arranged inside a rotatable developer carrying member, the magnet comprising:

a first magnetic pole; and a second magnetic pole arranged adjacent to the first magnetic pole in a rotation direction of the developer carrying member and having a same polarity as the first magnetic pole, wherein a groove is provided in the magnet over an entire region of the magnet in a longitudinal direction thereof to satisfy the following (i) to (iii):

(i) a third maximum peak position where a magnetic flux density of a component in a direction normal to the developer carrying member becomes maximal is on a surface of the developer carrying member on a downstream side of a first maximum peak position where the magnetic flux density of the component in the direction normal to the developer carrying member at the first magnetic pole becomes maximal and on an upstream side of a second maximum peak position where the magnetic flux density of the component in the direction normal to the developer carrying member at the second magnetic pole becomes maximal in the rotation direction of the developer carrying member;

(ii) a minimum peak position where the magnetic flux density of the component in the direction normal to the developer carrying member becomes minimal is on the surface of the developer carrying member on the downstream side of the first maximum peak position and on an upstream side of the third maximum peak position in the rotation direction of the developer carrying member, and the magnetic flux density of the component in the direction normal to the developer carrying member at the minimum peak position is more than 30% and less than 95% of the magnetic flux density of the component in the direction normal to the developer carrying member at the first maximum peak position; and (iii) a first magnetic force region where an absolute value of a magnetic force of the component in the direction normal to the developer carrying member is 1 [nN] or less is formed on the surface of the developer carrying member on a downstream side of the third maximum peak position and on the upstream side of the second maximum peak position in the rotation direction of the developer carrying member, and a second magnetic force region where the absolute value of the magnetic force of the component in the direction normal to the developer carrying member is 10 [nN] or less is formed on the surface of the developer carrying member on the downstream side of the first maximum peak position and on the upstream side of the third maximum peak position in the rotation direction of the developer carrying member.

17. The magnet according to claim 16, wherein the absolute value of the magnetic force of the component in the direction normal to the developer carrying member at the third maximum peak position is 10 [nN] or more.

18. The magnet according to claim 16, wherein the magnetic flux density of the component in the direction normal to the developer carrying member at the third maximum peak position is 120% or more of the magnetic flux density of the component in the direction normal to the developer carrying member at the minimum peak position.

19. The magnet according to claim 16, wherein the magnetic flux density of the component in the direction normal to the developer carrying member at the first maximum peak position is larger than the magnetic flux density of the component in the direction normal to the developer carrying member at the third maximum peak position.

20. The magnet according to claim 16, wherein a ratio of a cross-sectional area of the groove to a sum of a cross-sectional area of the magnet and the cross-sectional area of the groove in a cross section orthogonal to a rotation axis of the developer carrying member is more than 0.4% and less than 5.6%.

* * * * *